US005771543A

United States Patent [19]

Froidevaux et al.

[11] Patent Number: 5,771,543

[45] Date of Patent: Jun. 30, 1998

[54] LENGTH ADJUSTMENT DEVICE FOR A FOLDING ARM TYPE BRACELET CLASP

[75] Inventors: Vincent Froidevaux, Les Breuleux; Alberto Jaussi, Petit-Lancy, both of Switzerland

[73] Assignee: Montres Rolex S.A, Geneva, Switzerland

[21] Appl. No.: 892,585

[22] Filed: Jul. 14, 1997

[30] Foreign Application Priority Data

Jul. 17, 1996 [CH] Switzerland ..... 1783/96

[51] Int. Cl.[6] ..... A44B 11/00; A44C 5/00

[52] U.S. Cl. ..... 24/71 J; 24/69 J; 24/265 WS

[58] Field of Search ..... 24/715, 69 J, 68 J, 24/265 WS

[56] References Cited

U.S. PATENT DOCUMENTS

| | | | |
|---|---|---|---|
| 2,457,200 | 12/1948 | Bikoff | 24/71 J |
| 3,636,596 | 1/1972 | Ilizuka | 24/71 J |
| 3,696,469 | 10/1972 | Kalinsky | 24/71 J |
| 3,797,716 | 3/1974 | Mochizuki | 24/71 J |

FOREIGN PATENT DOCUMENTS

| | | |
|---|---|---|
| 653226 | 12/1985 | Switzerland . |
| 663522 | 12/1987 | Switzerland . |
| 1482575 | 10/1977 | United Kingdom . |

*Primary Examiner*—Victor N. Sakran
*Attorney, Agent, or Firm*—Henderson & Sturm

[57] ABSTRACT

This adjustment device comprises an adjustment link (6) provided with two parallel articulation axes (5,7) transverse to a bracelet, each serving to connect this adjustment link to two elements of the bracelet forming an endless attachment. This adjustment link is able to pivot about one of its axes (5) to that their respective positions are inverted, these two positions thus corresponding to two determined lengths of the bracelet. In the shorter adjusted position, the adjustment link (6) elastically engages in a recess (8*c*) of one of the articulated elements (8) of the adjustment link (6) by pressing this element (8) in the direction of the arrow ($F_7$) so that the adjusted position is maintained as long as the adjustment link (6) has not moved out of the recess (8*c*) in which it is elastically held by the locking means (8*d*) of the recess (8*c*).

20 Claims, 4 Drawing Sheets

LENGTH ADJUSTMENT DEVICE FOR A FOLDING ARM TYPE BRACELET CLASP

The present invention relates to a device for adjusting the length of a bracelet having a clasp made of folding arms arranged between the two ends of the bracelet to form therewith an endless attachment whose length can vary between two values, one where said folding arms are folded, the other where they are unfolded, comprising an adjustment link having two parallel articulation axes transversal to the attachment, these two articulation axes being associated respectively with two elements of the attachment to allow, by pivoting of said adjustment link about one of said axes, inversion of the respective positions of these two articulation axis relative to one another along said attachment to hence define two determined adjusted lengths of this attachment.

The purpose of this adjustment device is to provide the user, for each set length of the bracelet adjusted by conventional adjustment means, with an available supplementary length that corresponds to a small fixed difference with the initially adjusted length so that it is possible to easily go from one length of the bracelet to the other, without dexterity and without using a special tool. The difference between these two lengths is selected to take into account the differences in the wrist size depending on the ambient temperature and/or as a function of efforts that could be made by the user's arm and that could lead to swelling of the wrist. By means of such a device, it is possible to easily pass from one determined length to the other depending on whether the bracelet tightly grips the wrist or to the contrary does not sufficiently hold the wrist. This is important particularly, but not exclusively, for a wrist-watch.

A device of this type arranged in a folding clasp loop has already been described in Swiss patent CH-A5-663 522. The purpose of such a device is to be able to provide the bracelet with two determined lengths and hence permit the user to choose between these two different lengths simply by pivoting the adjustment link between its two positions; this pivoting from the longer adjusted position to the shorter one being carried out simply by applying a pressure on one of the arms of the clasp.

This device however has two major drawbacks, one from a practical standpoint, the other relating to aesthetic considerations, which detract largely from the advantages it offers. The first of these disadvantages resides in the fact that when the adjustment link is pivoted into its position corresponding to the shorter adjusted length, it is held in this position solely by the closure of the clasp. As soon as the clasp is opened, the adjustment link returns to the other position so that when the user puts the bracelet back on, he has to check whether the adjustment link is folded in the desired position and must pay attention that this does not alter during closing of the clasp.

The second of these drawbacks is due to the fact that the thickness of the adjustment link adds to that of the clasp's arms. This extra thickness is visible and detracts from the clasp's aesthetic appearance. Moreover, this extra thickness can interfere with passing a shirt cuff over the bracelet.

There are of course many other devices for adjusting the length of bracelets that enable the user to set the length himself. However, these devices generally are not designed to resolve the above-mentioned problem and are either too complicated or do not enable a choice between only two given lengths.

An object of the present invention is to at least partly remedy the above-mentioned drawbacks.

To achieve this, the present invention concerns a device for adjusting the length of a bracelet provided with a folding-arm clasp of the above type, as set out in claim 1.

The accompanying drawings illustrate, schematically and by way of example, an embodiment of the adjustment device according to the present invention and variations.

Figure 1:
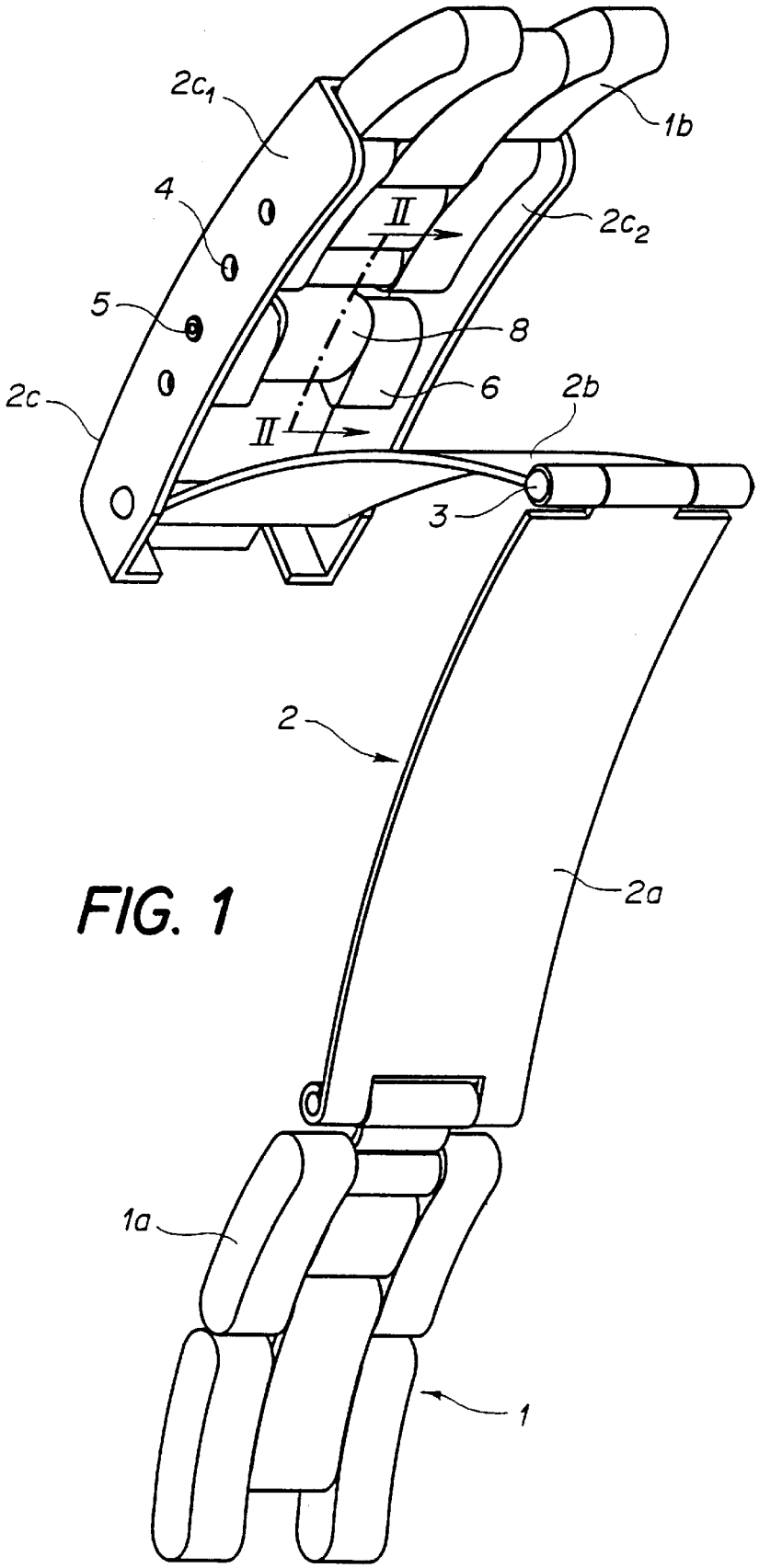
FIG. 1 is a perspective view of a portion of a bracelet fitted with this embodiment of the adjustment device.

The first embodiment of the adjustment device according to the present invention, illustrated in FIGS. 1 to 4, comprises a partly-shown metal bracelet made of links 1, whose two ends 1*a*,1*b* are attached to a folding-arm clasp 2 comprising two arms 2*a*,2*b* articulated to one another about a pin 3. One of these arms 2*a* is articulated to the end 1*a* of the bracelet, whereas the other end 1*b* of the bracelet is articulated to a third arm 2*c* of the clasp having two parallel lateral walls $2c_1$,$2c_2$ forming a housing under which the arms 2*a*,2*b* fold. The two parallel lateral walls $2c_1$,$2c_2$ of this housing 2*c* comprise two respective series of apertures 4 in two-by-two facing relationship, for receiving a pivoting axis 5 (called "bar") for attaching the other end 1*b* of the bracelet, and which constitute conventional first means for adjusting the length of the bracelet.

It is at this other end 1*b* of the bracelet that there is provided another device for adjusting the bracelet length, viz. the device according to the invention.

Figure 2:
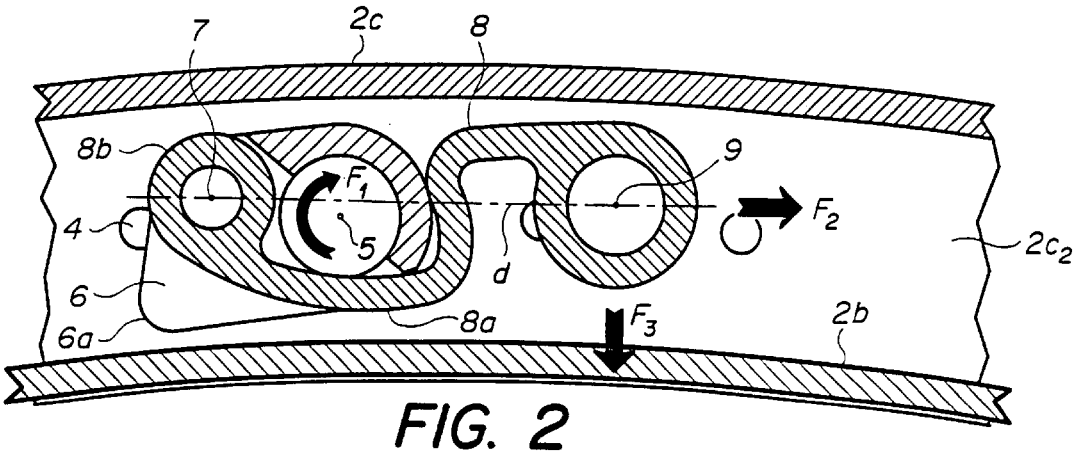
FIG. 2 is a partial view in cross-section along line II—II of FIG. 1.

A link 6 is pivotally mounted about the axis of the bar 5 fixed in two apertures 4 of the facing lateral walls $2c_1$,$2c_2$ of the cover 2*c*. This link 6 constitutes the bracelet-length adjustment link. For this, this adjustment link 6 (FIGS. 2 to 4) includes a second articulation axis 7 to which is articulated one end of a second link 8 whose other end is articulated to the remainder of the bracelet end 1*b* about an axis 9. As can be seen in particular on FIG. 4, this link 8 includes a curved blade 8*a* which is tangential to a portion 8*b* of cylindrical section coaxial with the articulation axis 7 at one end, whereas at its other end, this curved blade 8*a* is folded over to form, with the portion 8*b* of cylindrical section and the blade 8*a*, a wall 8*d*, providing a recess 8*c* adapted to receive the adjustment link 6, as illustrated in FIG. 2. This wall 8*d* has an S-shaped profile hence forming a restricted opening leading into the recess 8*c*, whose dimension is calculated to be slightly less than the corresponding dimension of the part of the adjustment link 6 that engages in the recess 8*c*, as can be seen in particular in FIG. 3. This wall 8*d* thus serves as a locking means for the adjustment link 6 when it is engaged in this recess 8*c* by elastic deformation.

Figure 3:
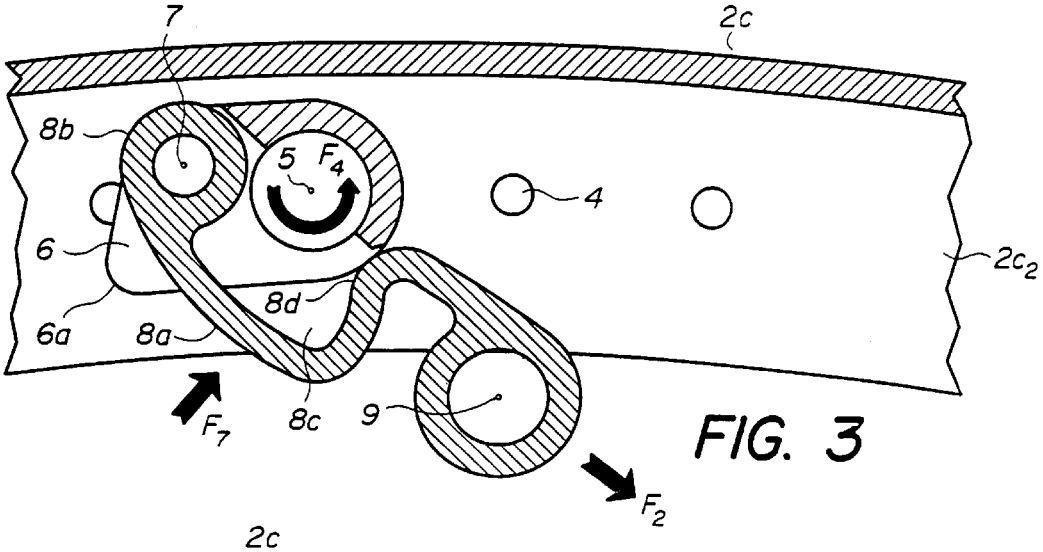
FIGS. 3 and 4 are cross-sectional views similar to that of FIG. 2, in two different positions of the adjustment device.

It can be observed on FIG. 2 that in this position of the adjustment device, a straight line d, drawn in a chain-line, joining the articulation axes 7 and 9 between, on the one hand, the two links 6 and 8 and, on the other hand, the link 8 and the remainder of the bracelet, is spaced apart by a given distance from the pivoting axis 5 of the adjustment link 6 under the clasp's cover 2*c*, hence forming a lever arm about the axis 5. The side of axis 5 where this lever arm is situated is chosen to provide a couple tending to turn the adjustment link 6 in the direction of arrow F1 when a traction is exerted on the bracelet in the direction of arrow $F_2$ (FIG. 2). This couple tends to hold the adjustment link 6 engaged in the recess 8*c* of link 8. To disengage it, it suffices to exert, on the axis 9 of link 8 at the end of the bracelet's part 1*b* (FIG. 1), a traction in the direction of arrow $F_3$ (FIG. 2) whereafter the adjustment link can pivot in the direction of arrow F4 by exerting on the link 8 a traction in the direction of arrow $F_2$ (FIG. 3). This pivoting of the adjustment link 6 is limited by an abutment 6*a* which comes to contact the internal face of the cover 2*c* of clasp 2 (FIG. 4).

Figure 4:
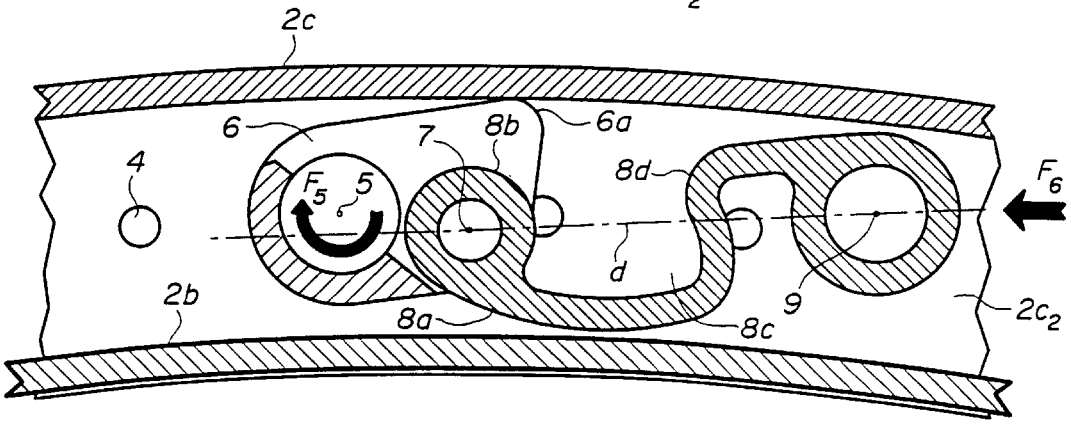

As can be seen on FIG. 4 which illustrates the adjustment device in the longer position of the bracelet provided by this device, the straight line d in chain lines, joining the axes 7 and 9 of link 8, once again does not pass through the pivoting axis 5 of the adjustment link 6. In this case, the lever arm about the axis 5 tends to produce a couple in direction $F_5$ when a force in direction $F_6$ is exerted on the link 8 (FIG. 4), tending to return the adjustment link 6 back to the position of FIG. 2, after having exerted a pressure on the link 8 in direction $F_7$ (FIG. 3) to engage it in the recess 8*c*.

The adjustment device according to the invention allows a choice between two given bracelet lengths. Passing from one position to the other can only be done voluntarily and by a simple manipulation that does not require any particular dexterity on the part of the user. Once set in a position, there is no risk that the length changes unwantedly. The adjusted length is maintained as long as the user does not decide to change. The clasp can be opened and closed without modifying the setting. It can also be remarked that in either of the adjusted positions, the height of the clasp remains practically unchanged, so that the device does not detract from the aesthetic appearance.

In the four variations illustrated by FIGS. 5 to 8, the clasp has not been illustrated, given that it remains the same. The adjustment link 6 is also identical to that of FIGS. 1 to 4. The modifications thus principally relates to the link 8 articulated about the axis 7 of adjustment link 6. The part 1*b* of the bracelet proper connected to the articulation axis 9 of link 8 can have any suitable form. In the examples, metal bracelets composed of links are shown. However, other bracelets, for example of leather or plastics, could be used. Moreover, the bracelet can be a watch bracelet or any other type of bracelet fitted with a folding-arm clasp or a comparable clasp, or generally any bracelet forming with its clasp an endless attachment.

Figure 5:
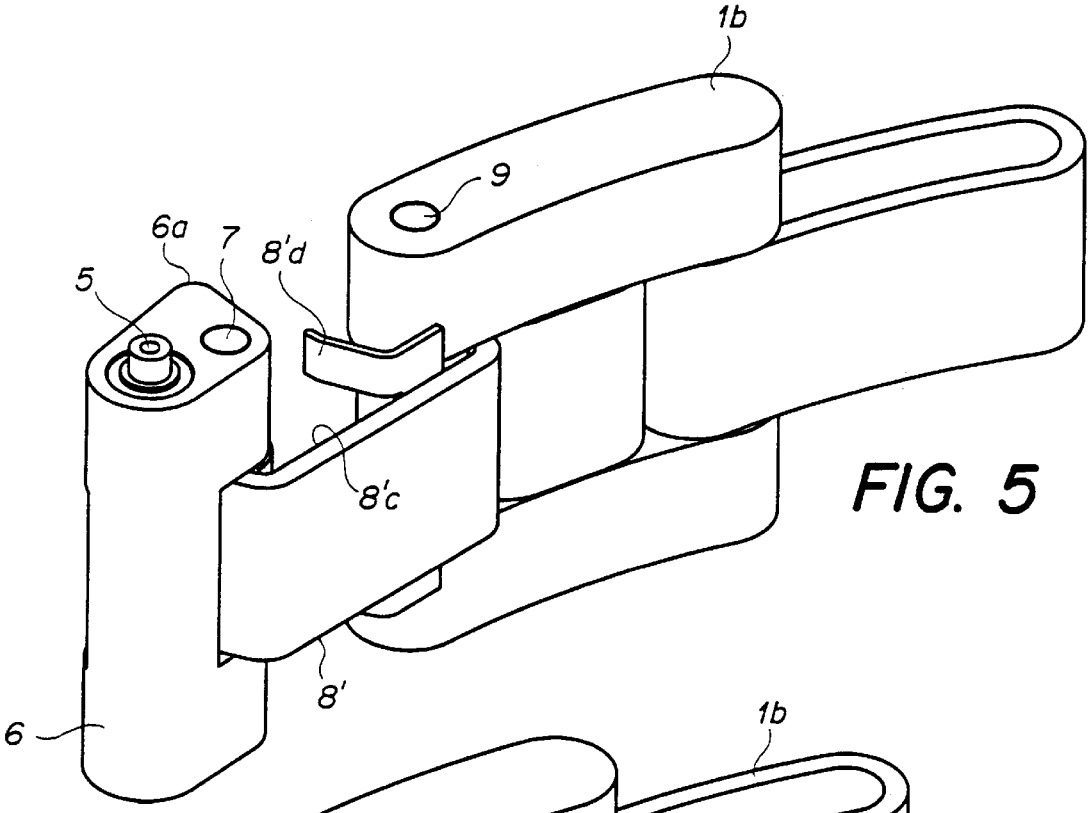
FIG. 5 is a partial perspective view of a variation of the adjustment device in the long adjusted position.

In the variation illustrated in FIG. 5, the wall 8*d* of the recess 8'*c* of link 8 which serves as means for locking the adjustment link 6 is constituted by a piece 8'*d* welded to the link 8'. This variation enables this piece 8'*d*, constituting elastic locking means, to be made specifically for this purpose to obtain the required elastic force independently of the link 8'. Thus, this fitted element 8'*d* can have a different thickness than the link 8' or can be made of a different material. For example, for a gold bracelet, it can be advantageous to have a fitted element of another material, for example steel, because of its better elasticity.

Figure 6:
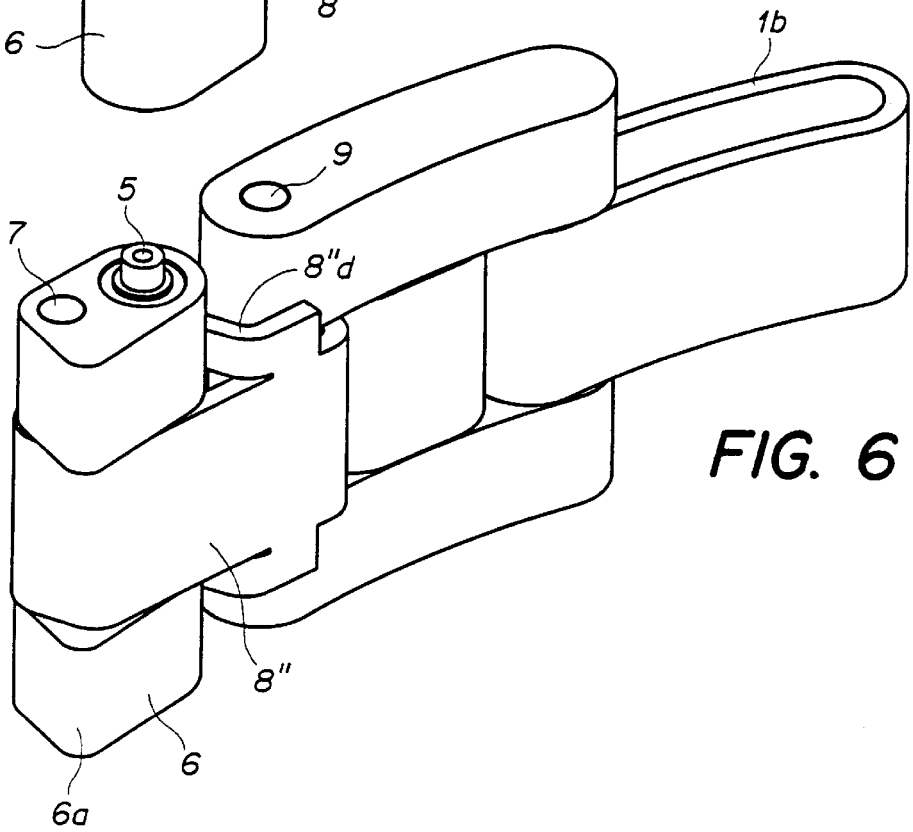
FIG. 6 is a partial perspective view of a variation of the adjustment device in the short adjusted position.

The variation of FIG. 6, which shows the adjustment device in the other adjusted position, differs from that of FIG. 5 only by the fact that the blades 8"*d* forming the locking means are machined in the link 8" itself and are not formed by a fitted piece.

Figure 7:
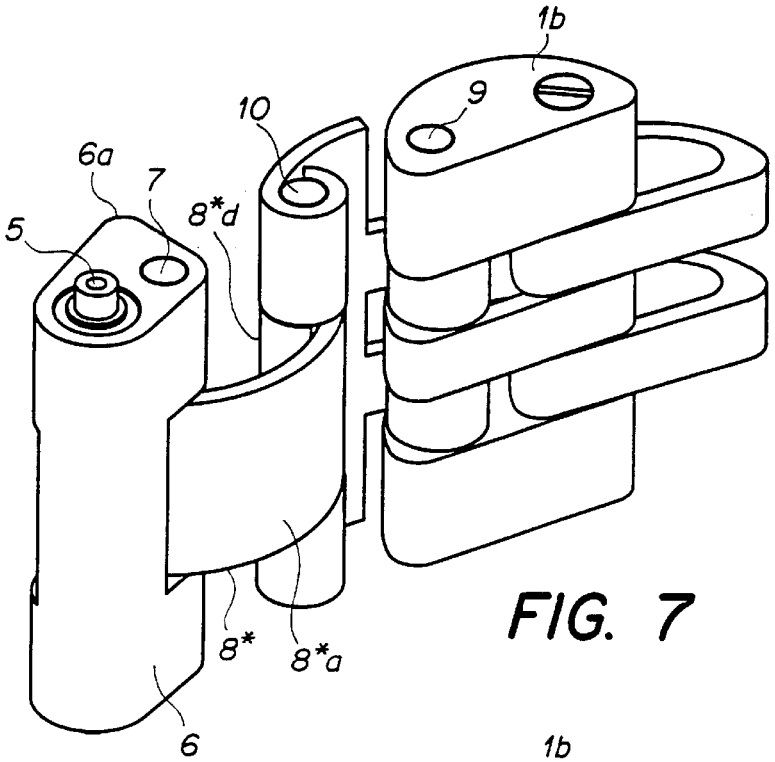
FIGS. 7 and 8 are partial perspective views similar, respectively, to FIGS. 5 and 6 of two further variations of the adjustment device.
Figure 8:
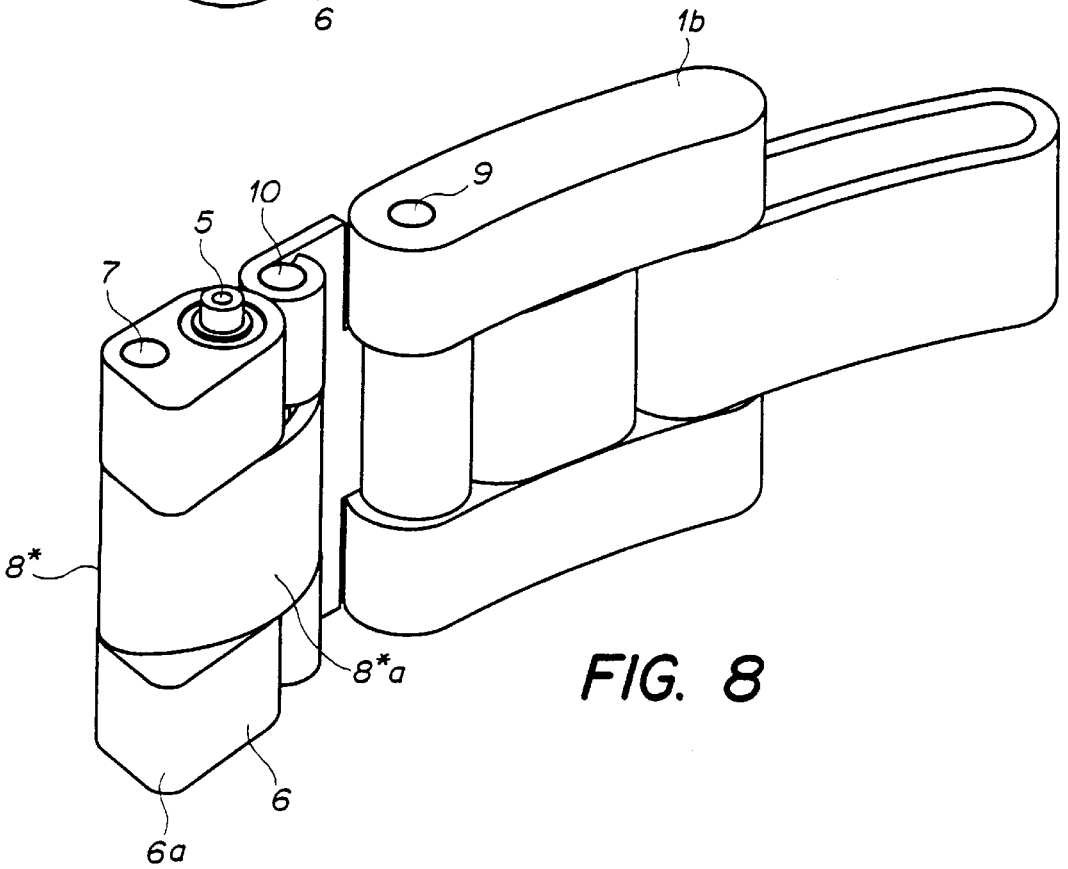

In the variation illustrated by FIGS. 7 and 8, the link 8* is in two parts articulated to one another about a pin 10. The locking element of the adjustment link 6 is hence directly constituted by the two parts 8*d* of this link 8* surrounding the pin 10 about which they are articulated. In the case, the elasticity of the locking means 8*d* is conferred solely by the curved part 8*a* of link 8*. FIGS. 7 and 8 show different bracelets, both metallic with articulated links but, as mentioned, the invention is not limited to a particular type of bracelet.

Furthermore, the variations of FIGS. 5 to 8 have all of the advantages mentioned in connection with the embodiment of FIGS. 1 to 4.

We claim:

1. A device for adjusting a length of a bracelet having a clasp made of comprising folding arms arranged between two ends of the bracelet to form therewith an endless attachment whose length can vary between two values, one where said folding arms are folded, the other where said folding arms are unfolded, said device comprising an adjustment link having two articulation axes which are substantially parallel transverse to the attachment, said two articulation axes being associated respectively with two element of said attachment to allow, by pivoting of said adjustment link about one of said articulation axes, inversion of respective positions of said articulation axes relative to one another along said attachment to define two determined adjusted lengths of said attachment, wherein one of said two elements of said attachment comprises locking means arranged in a trajectory described by a portion of said adjustment link when said adjustment link pivots from a position corresponding to a longer adjusted length to another position corresponding to a shorter adjusted length of said attachment, to come into engagement with said portion of said adjustment link in said another position corresponding to the shorter adjusted length of said attachment.

2. An adjustment device according to claim 1, wherein said locking means comprise elastic means.

3. An adjustment device according to claim 2, wherein elasticity of said locking means is provided by a curved blade of said second link, the locking means being arranged at one end of said curved blade.

4. An adjustment device according to claim 2, wherein said adjustment link is arranged between one of said two ends of the bracelet and the clasp.

5. An adjustment device according to claim 2, wherein said locking means are substantially solid with a second link articulated to one of the articulation axes of said adjustment link and to one end of the bracelet, and another of said elements to which said one of said articulation axes of said adjustment link is articulated is one of the arms (2*b*) of said clasp, and said adjustment link has an abutment adapted to limit angular displacement thereof against a face of an arm of the clasp to which it is articulated, in a position in which said adjustment link defines the longer adjusted length.

6. An adjustment device according to claim 5, wherein said abutment of said adjustment link bears against said face of an arm of the clasp, the pivoting axis (5) of said adjustment link being situated on one side of a straight line passing through the two articulation axes of said second link selected such that a pressure ($F_6$) exerted in a direction of said straight line generates, about the pivoting axis of said adjustment link, a couple tending to turn said adjustment link from a position corresponding to the longer adjusted length to another position corresponding to the shorter adjusted length of said attachment.

7. An adjustment device according to claim 2, wherein said adjustment link is in engagement with said locking means, the pivoting axis of said adjustment link being situated on one side of a straight line passing through the two articulation axes of said second link selected such that a tractive force ($F_2$) exerted in a direction of said straight line generates, about a direction of said adjustment link in engagement with said locking means.

8. An adjustment device according to claim 2 wherein elastic locking means are fitted on said second link.

9. An adjustment device according to claim 1, wherein said adjustment link is arranged between one of said two ends of the bracelet and the clasp.

10. An adjustment device according to claim 9, wherein said locking means are substantially solid with a second link articulated to one of the articulation axes of said adjustment link and to one end of the bracelet, and another of said elements to which said one of said articulation axes of said adjustment link is articulated is one of the arms (2*b*) of said clasp, and said adjustment link has an abutment adapted to limit angular displacement thereof against a face of an arm of the clasp to which it is articulated, in a position in which said adjustment link defines the longer adjusted length.

11. An adjustment device according to claim 10, wherein said abutment of said adjustment link bears against said face of an arm of the clasp, the pivoting axis (5) of said adjustment link being situated on one side of a straight line passing through the two articulation axes of said second link selected such that a pressure ($F_6$) exerted in a direction of said straight line generates, about the pivoting axis of said adjustment link, a couple tending to turn said adjustment link from a position corresponding to the longer adjusted length to another position corresponding to the shorter adjusted length of said attachment.

12. An adjustment device according to claim 9, wherein said adjustment link is in engagement with said locking means, the pivoting axis of said adjustment link being situated on one side of a straight line passing through the two articulation axes of said second link selected such that a tractive force ($F_2$) exerted in a direction of said straight line generates, about a direction of said adjustment link in engagement with said locking means.

13. An adjustment device according to claim 9 wherein elastic locking means are fitted on said second link.

14. An adjustment device according to claim 1, wherein said locking means are substantially solid with a second link articulated to one of the articulation axes of said adjustment link and to one end of the bracelet, and another of said elements to which said one of said articulation axes of said adjustment link is articulated is one of the arms (2*b*) of said clasp, and said adjustment link has an abutment adapted to limit angular displacement thereof against a face of an arm of the clasp to which it is articulated, in a position in which said adjustment link defines the longer adjusted length.

15. An adjustment device according to claim 14, wherein said abutment of said adjustment link bears against said face of an arm of the clasp, the pivoting axis (5) of said adjustment link being situated on one side of a straight line passing through the two articulation axes of said second link selected such that a pressure ($F_6$) exerted in a direction of said straight line generates, about the pivoting axis of said adjustment link, a couple tending to turn said adjustment link from a position corresponding to the longer adjusted length to another position corresponding to the shorter adjusted length of said attachment.

16. An adjustment device according to claim 14, wherein said adjustment link is in engagement with said locking means, the pivoting axis of said adjustment link being situated on one side of a straight line passing through the two articulation axes of said second link selected such that a tractive force ($F_2$) exerted in a direction of said straight line generates, about a direction of said adjustment link in engagement with said locking means.

17. An adjustment device according to claim 14 wherein elastic locking means are fitted on said second link.

18. An adjustment device according to claim 1, wherein said adjustment link is in engagement with said locking means, the pivoting axis of said adjustment link being situated on one side of a straight line passing through the two articulation axes of said second link selected such that a tractive force ($F_2$) exerted in a direction of said straight line generates, about a direction of said adjustment link in engagement with said locking means.

19. An adjustment device according to claim 1 wherein elastic locking means are fitted on said second link.

20. An adjustment device according to claim 1 wherein said second link has a recess.

* * * * *

UNITED STATES PATENT AND TRADEMARK OFFICE

CERTIFICATE OF CORRECTION

PATENT NO. : 5,771,543
DATED : June 30, 1998
INVENTOR(S) : Vincent Froidevaux and Alberto Jaussi It is certified that error appears in the above-indentified patent and that said Letters Patent is hereby corrected as shown below:

In the Claims:

At column 4, Claim 1, line 10, please delete "made of".

Signed and Sealed this

Twenty-seventh Day of April, 1999

*Attest:*

Q. TODD DICKINSON

*Attesting Officer*

*Acting Commissioner of Patents and Trademarks*